US005482493A

United States Patent [19]

Rapisarda

[11] Patent Number: 5,482,493

[45] Date of Patent: Jan. 9, 1996

[54] TOYS WITH A BATTERY POWERED LIGHT EMITTING DIODE LIGHTED BY MOVEMENT

[76] Inventor: Carmen C. Rapisarda, 2650 Myrtle Ave. #B-7, Monrovia, Calif. 91016

[21] Appl. No.: 199,586

[22] Filed: Feb. 22, 1994

[51] Int. Cl.[6] ..... A63H 17/28

[52] U.S. Cl. ..... 446/438; 446/485

[58] Field of Search ..... 446/409, 438, 446/439, 441, 484, 485; 273/58 E, 58 G

[56] References Cited

U.S. PATENT DOCUMENTS

| | | | |
|---|---|---|---|
| 2,599,208 | 6/1952 | Starr | 446/439 |
| 2,849,819 | 9/1958 | Murphy et al. | 273/58 G |
| 3,580,575 | 5/1971 | Speeth | 273/58 G |
| 3,610,916 | 10/1971 | Meehan | 446/485 |
| 3,935,669 | 2/1976 | Potrzuski et al. | 273/58 G |
| 4,193,223 | 3/1980 | D'Andrade et al. | 446/438 |
| 4,559,022 | 12/1985 | Herstein et al. | 446/438 |
| 4,964,837 | 10/1990 | Collier | 446/409 |

FOREIGN PATENT DOCUMENTS

| | | | |
|---|---|---|---|
| 33434 | 11/1964 | Germany | 446/485 |
| 2014461 | 8/1979 | United Kingdom | 446/485 |

*Primary Examiner*—Robert A. Hafer
*Assistant Examiner*—Jeffrey D. Carlson
*Attorney, Agent, or Firm*—Edgar W. Averill, Jr.

[57] ABSTRACT

An assembly mounted in a toy containing a light emitting diode and a battery. The light emitting diode lights when the module is moved. The assembly may be mounted in a toy such as a toy truck with rough tires and the vibration caused by rolling the truck on a flat surface causes the light emitting diode to go on and off. The diode is energized by a movable weight positioned above a wafer battery in the assembly.

11 Claims, 4 Drawing Sheets

Fig. 4
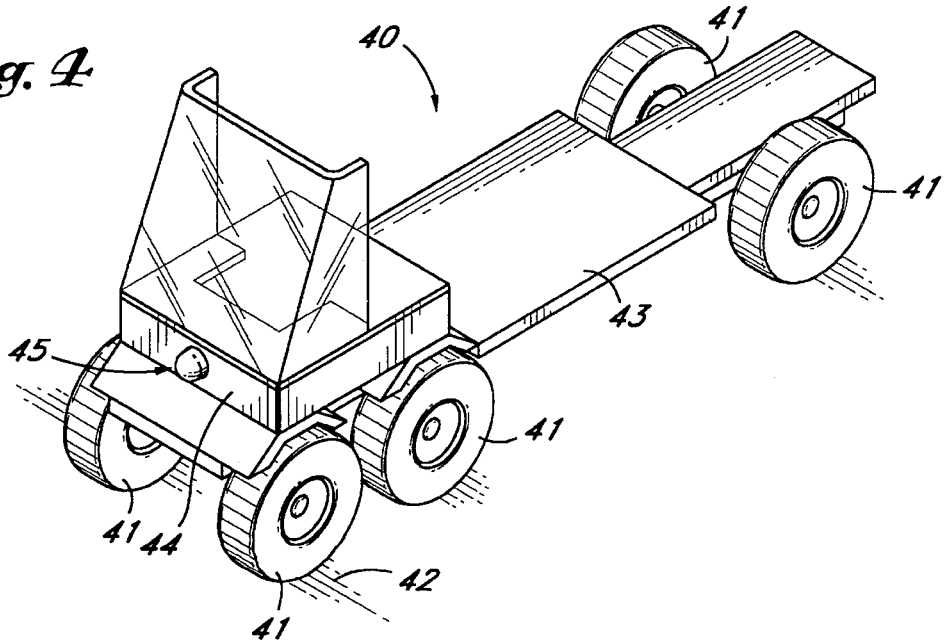
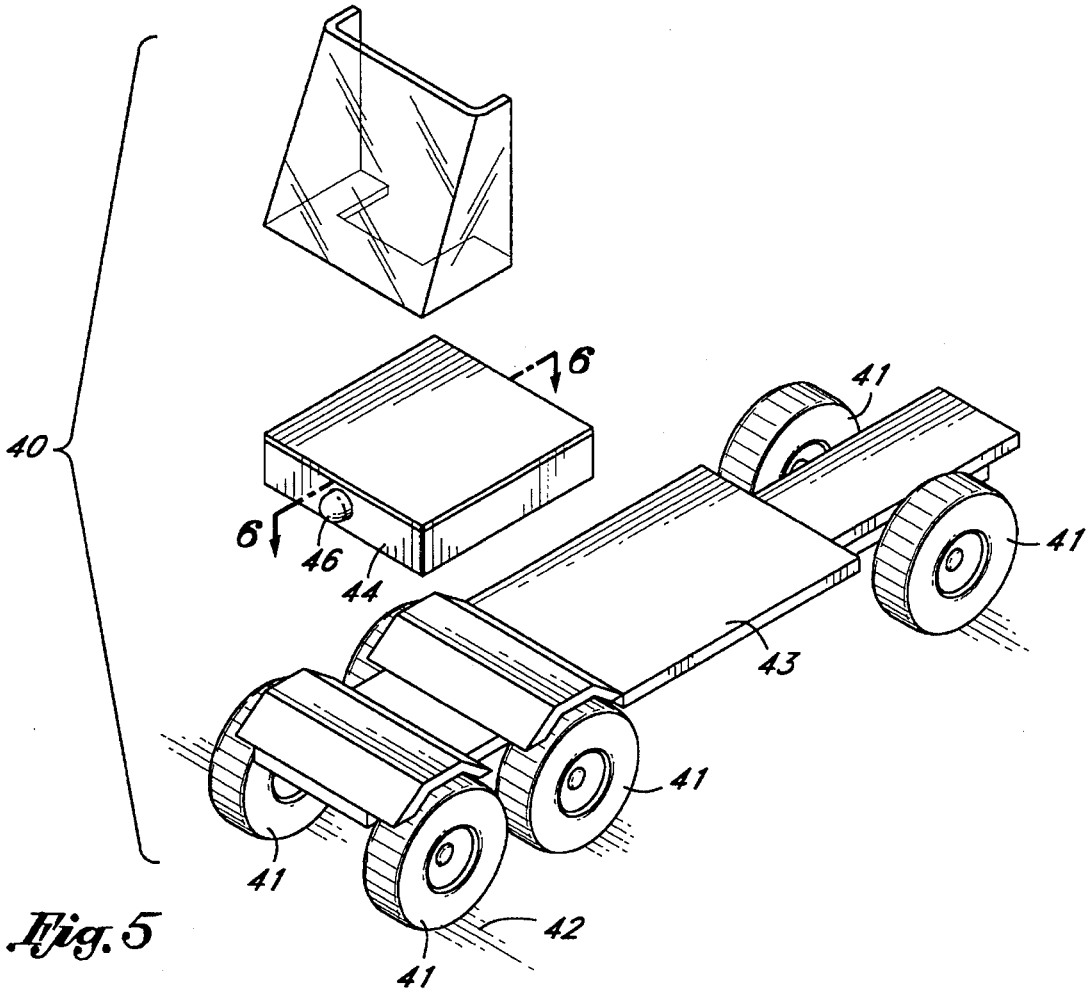
Fig. 5

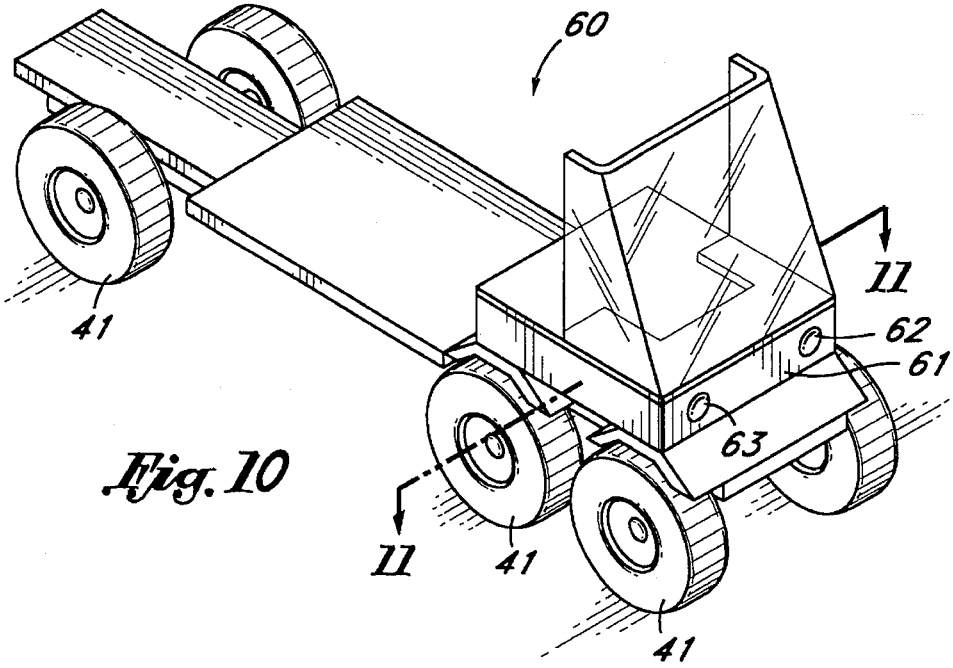
Fig. 10
Fig. 11
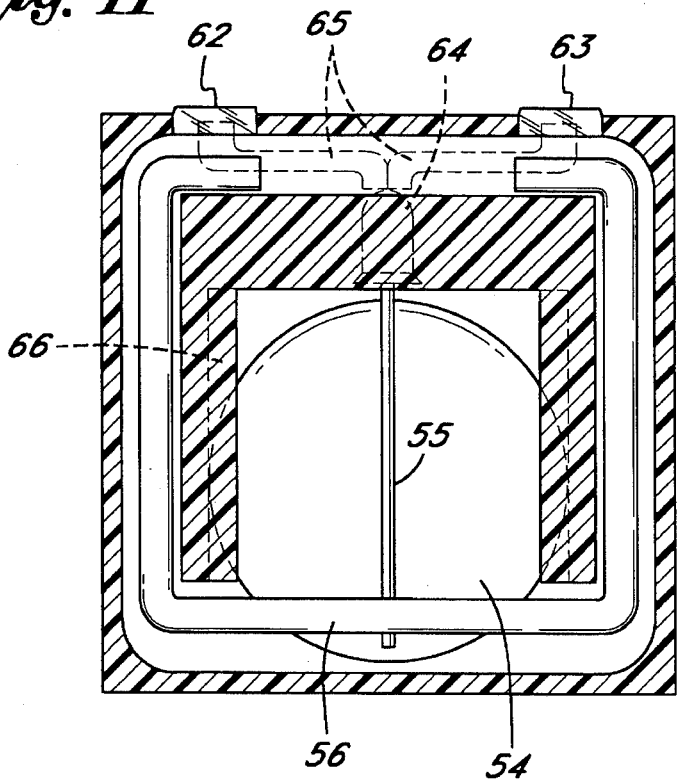

TOYS WITH A BATTERY POWERED LIGHT EMITTING DIODE LIGHTED BY MOVEMENT

BACKGROUND OF THE INVENTION

The field of the invention is lighting and the invention relates more particularly to lights used in toys.

Battery operated lights are widely used in toys to add to the excitement of using the toy. Unfortunately children often leave the switch on and the battery is quickly dissipated. Another style of light-containing toy uses a generator which generates sufficient electricity to light a light but such toys are relatively expensive and require a smooth surface to operate properly.

Light emitting diodes (LEDs) have been widely used recently in shoes which light when the wearer exerts pressure on the heel by walking. Also, a module containing an LED has been devised wherein the leads to the LED are placed near the poles of a wafer battery and a weight is suspended over one of the leads of the LED. Movement of the shoe moves the weight which in turn moves the LED lead into contact with a pole of the wafer battery completing the circuit and lighting the LED.

SUMMARY OF THE INVENTION

It is an object of the present invention to provide a light assembly for use in a toy which is operated when the toy is moved, but is not otherwise energized.

The present invention is for an assembly positioned in a toy. The assembly having a frame with at least a right side, a left side and a front. A wafer battery is held by the right and left sides of the frame, said battery having an upper terminal and a lower terminal. A light emitting diode is held by the front of the frame and has a light emitting portion from which an upper and lower metallic conductor or lead extend in a generally horizontal manner. The upper and lower termini are positioned so that there is an upper and a lower conductor lead and the lower conductor lead is shaped so that it is in continuous contact with the lower terminal of the wafer battery. The upper lead of the LED is spaced closely to the battery and has a weight urging the upper lead downwardly and into contact with the upper terminal of the wafer battery. Even the slight vibration caused for instance by rolling a toy truck with slightly knobby wheels on a smooth surface will cause the upper lead and weight to vibrate up and down and make many contacts with the upper terminal of the wafer battery causing the LED to light.

BRIEF DESCRIPTION OF THE DRAWINGS

FIG. 4 is a perspective view of a different style of toy truck showing the front, left side and top thereof.

FIG. 5 is an exploded perspective view of the truck of FIG. 4.

FIG. 10 is a perspective view of an alternate embodiment of the toy truck of FIG. 4.

FIG. 11 is a cross-sectional view taken along line 11—11 of FIG. 10.

DESCRIPTION OF THE PREFERRED EMBODIMENTS

Figure 1:
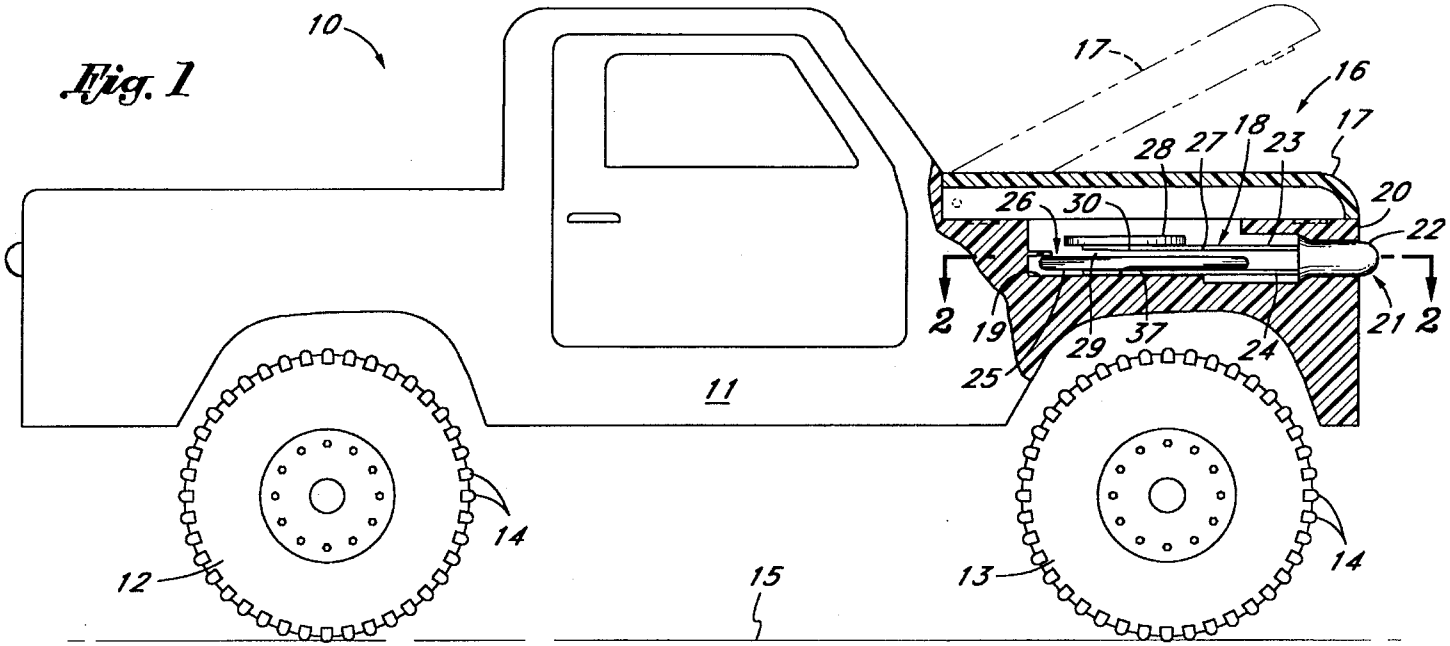
FIG. 1 is a side view of a toy truck partially in cross-section.

A toy truck is shown in side view in FIG. 1 and indicated generally by reference character 10. Toy truck 10 has a body 11 and four wheels, two of which are indicated by reference characters 12 and 13. Wheels 12 and 13 are shown as knobby wheels having knobby treads 14. Toy truck 10 is shown resting on a smooth surface 15.

In the hood area 16, a hood 17 is shown in a closed position and also in an open position in a phantom view. The engine compartment 18 has a hollowed out portion with a floor 19 and a front area 20. An LED 21 has a light emitting portion 22, an upper lead 23 and a lower lead 24. Lower lead 24 is in contact with the lower terminal 25 of wafer battery 26. The upper lead 27 of LED 21 rests above upper terminal 30 of wafer battery 26 and a weight 28 rests on the upper lead 27 and moves it downwardly slightly but leaves a gap 29 between the upper lead terminal 27 of LED 21 and the upper battery terminal 30. This gap should be very small in the range of 0.020 inches and it has been found that the very small movement caused by the rolling of treads 14 on a smooth surface 15 will be sufficient to light the LED in what appears to be an almost continuous manner. The effect of the front lights of toy truck 10 which are LEDs lighting as the truck is rolled along a smooth surface is very remarkable and it appears that the truck is generating electricity.

Figure 2:
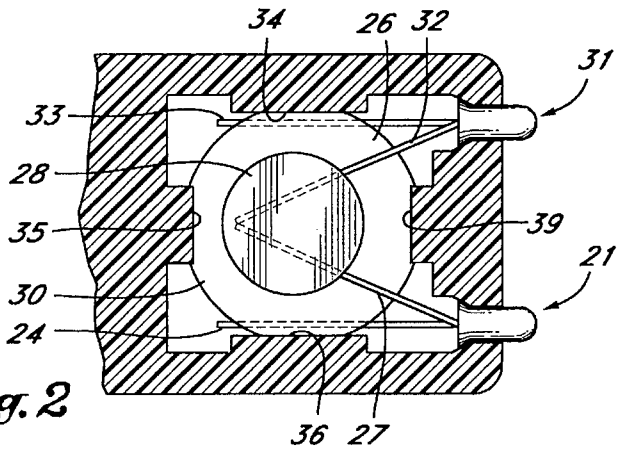
FIG. 2 is a cross-sectional view taken along line 2—2 of FIG. 1.

The LED and battery assembly is shown in cross-sectional view in FIG. 2 where it can be seen that there are two LEDs 21 and 31, each of which have upper leads 27 and 32 and lower leads 24 and 33. The weight 28 is shown in FIG. 2 as a disk shaped weight, but of course need not be a disk shaped weight. Preferably, weight 28 should be insulated and it is contemplated that a painted or otherwise insulated metal weight would be used. It can also be seen in FIG. 2 that battery 26 is held in the engine compartment 18 by four arms 34, 35, 36 and 39. Preferably, engine compartment 18 has a floor 37 which securely holds lower lead 24 against the lower terminal 25 of battery 26.

Figure 3:
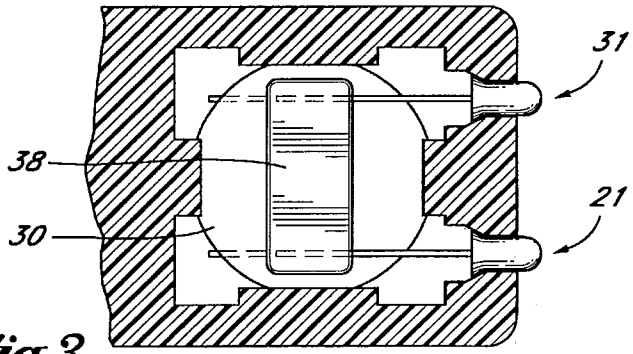
FIG. 3 shows an alternate embodiment of the device of FIG. 2.
Figure 6:
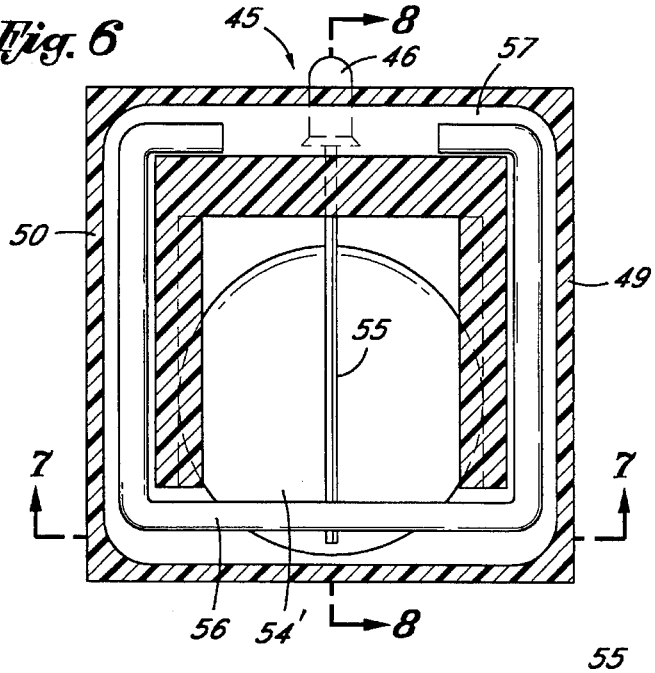
FIG. 6 is a cross-sectional view taken along line 6—6 of FIG. 5.
Figure 7:
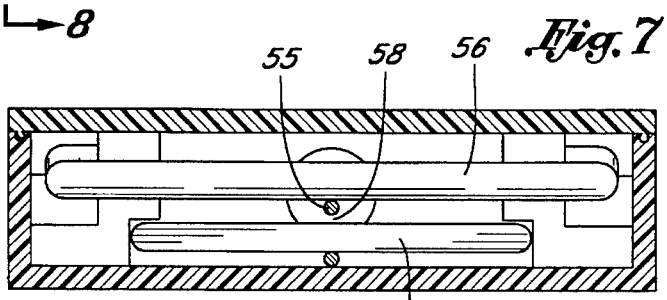
FIG. 7 is a cross-sectional view taken along line 7—7 of FIG. 6.
Figure 8:
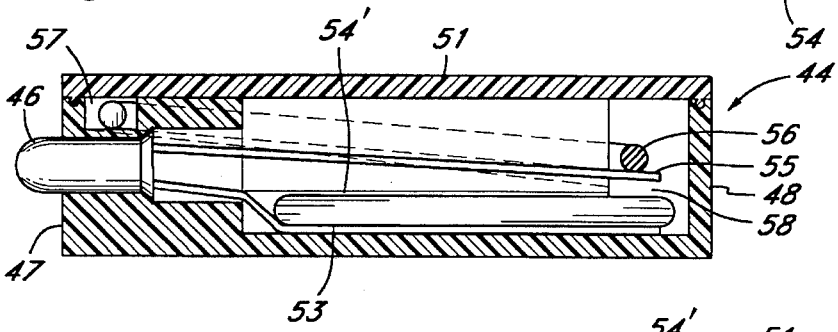
FIG. 8 is a cross-sectional view taken along line 8—8 of FIG. 6.

An alternate embodiment is shown in FIG. 3 where a generally rectangular weight 38 is substituted for the disk shaped weight 28 of FIG. 2. Also, the LEDs and upper leads are both directed rearwardly in FIG. 3.

An alternate embodiment is shown in FIG. 4 where vehicle 40 has six wheels 41, which rest on floor 42. A truck bed 43 supports a box 44 which holds a single LED indicated generally by reference character 45 which as seen in FIGS. 6 through 9 has a light-emitting portion 46. As seen best in the cross-sectional view of FIGS. 7 and 8, box 44 has a front 47, a back 48, a right side 49 and a left side 50. Box 44 also has a top 51. LED 45 is held in a cavity in front 47 so that its light-emitting portion 46 extends outwardly from front 47 and its lower lead 52 is in continuous contact with the bottom terminal 53 of wafer battery 54. Upper battery terminal 54' is held out of contact with upper LED lead 55 which is urged downwardly by hinged weight 56. Hinged weight 56 is held hingedly at its front end in a cavity 57 and rests on upper lead 55 as shown best in FIGS. 8 and 9. Hinged weight 56 is freely hinged which means that the weight loosely pivots at its hinged point at its hinged point at its front end.

Figure 9:
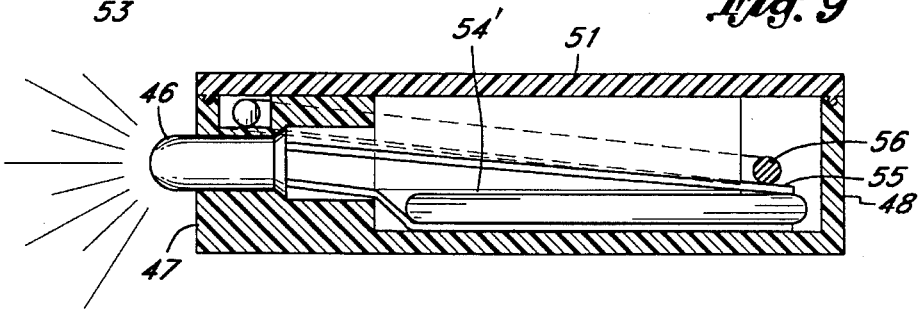
FIG. 9 is a cross-sectional view analogous to FIG. 8, except showing the upper conductor lead in contact with the upper terminal of the wafer battery.

As the truck 40 is vibrated by rolling it along a floor 42, inertia moves the weight downwardly as shown in FIG. 9 to cause the LED to light. Once again, as discussed above, this vibration can be very minimal and the gap 58 between the upper LED lead 55 and the upper battery terminal 54' is very slight such as 0.020 inches.

An alternate embodiment of vehicle is shown in FIG. 10, indicated by reference character 60. Vehicle 60 has the same elements as vehicle 40, except that box 61 has a pair of headlights 62 and 63 which are lighted as shown in FIG. 11. In FIG. 11 it can be seen that LED 64 has a light-emitting portion which is positioned so that a pair of optical paths 65 made from a material such as an acrylic plastic will transmit the light to headlights 62 and 63. The wafer battery, as above, is held in a groove 66 in box 61 which securely maintains it in place and hinged weight 56 is shown as the means by which the upper LED lead 55 contacts the upper battery terminal 54'.

The result is a toy which has the advantage of remaining off during shipping, particularly if the vehicle is packaged upside down in the shipping container and the vehicle also remains unlit when it is not being used by a child. Thus, the battery remains fresh for use. While the invention has been shown in conjunction with a toy truck, it of course can be used with other toys which are subject to slight movement, although wheeled vehicles provide an especially useful environment. The weight need not be very great and a typical weight would be five (5) grams and as shown in the drawings may be hinged or freely supported.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. An amusement device having an assembly positioned in a toy, said amusement device comprising:

a toy:

an assembly frame held by said toy, said assembly frame having a floor, a right side and a left side and a front;

a wafer battery held by said assembly frame having an upper face and a lower face and having a positive terminal on one face and a negative terminal on the other face;

a light emitting diode held by said frame having a light emitting portion from which an upper and a lower metallic lead extend in a generally horizontal manner, said upper and lower leads having end termini and a space between them and said light emitting diode being positioned so that the wafer battery is held in said space between the leads so that the upper metallic lead is above the wafer battery and the lower metallic lead is below and in contact with the lower face of the wafer battery; and a movable weight movably held by said assembly frame so that it can move up and down, said movable weight being positioned so that it is resting on without attachment and supported by said upper metallic lead and its weight is not sufficient to move the upper metallic lead into contact with the upper face of the wafer battery but when the amusement device is moved upwardly, the inertial force on the movable weight, causes the weight to push the upper lead into electrical contact with the upper face of the wafer battery thereby completing a circuit and lighting the light emitting diode.

2. The amusement device of claim 1 wherein the movable weight is a hinged movable weight.

3. The amusement device of claim 1 wherein said toy is a toy with wheels which have a roughened surface.

4. The amusement device of claim 3 wherein the toy is a toy vehicle.

5. The amusement device of claim 1 wherein said assembly frame holds one light emitting diode.

6. The amusement device of claim 1 wherein said assembly frame holds a plurality of light emitting diodes.

7. The amusement device of claim 1 further including a transparent light path leading from the light emitting part of the light emitting diode to a remote location.

8. An amusement device having an assembly mounted in a toy, said amusement device comprising:

a toy;

an assembly frame held by said toy, said assembly frame having a floor, a right side and a left side and a front;

a wafer battery held by said assembly frame having an upper face and a lower face and having a positive terminal on one face and a negative terminal on the other face;

a light emitting diode having a light emitting portion held by the front of said assembly frame, an upper and a lower metallic lead extending from the light emitting portion in a generally horizontal manner, said upper and lower leads having end termini and a space between them and said light emitting diode being positioned so that the wafer battery is held in said space between the leads so that the upper metallic lead is above the wafer battery and the lower metallic lead is below and in contact with the lower face of the wafer battery; and a freely hinged movable weight having a hinged end and a movable end and positioned so that its movable end can move up and down, said hinged movable weight being positioned so that its movable end is supported on and above without attachment said upper metallic lead and the weight of the movable end is not sufficient to move the upper metallic lead into contact with the upper face of the wafer battery when the weight is at rest but when the amusement device is moved upwardly, the inertial force on the movable end of the movable weight causes the weight to push the upper lead downwardly into electrical contact with the upper face of the wafer battery thereby completing a circuit and lighting the light emitting diode.

9. The amusement device of claim 8 wherein said assembly is mounted in a toy having wheels.

10. The amusement device of claim 9 wherein said wheels have a knobby exterior surface so that the assembly vibrates up and down as the toy is rolled along on its wheels.

11. The amusement device of claim 8 wherein said hinged movable weight is metal loop.

* * * * *